United States Patent [19]

Mannion et al.

[11] Patent Number: 4,464,198

[45] Date of Patent: Aug. 7, 1984

[54] APPARATUS AND PROCESS FOR THE TREATMENT OF MOLTEN METAL

[75] Inventors: Geoffrey Mannion, Horsham; Patrick V. Palmer, Hove, both of England

[73] Assignee: The International Meehanite Metal Company Limited, Surrey, England

[21] Appl. No.: 458,194

[22] Filed: Jan. 17, 1983

[30] Foreign Application Priority Data

Jan. 20, 1982 [GB] United Kingdom ..... 8201538

[51] Int. Cl.[3] ..... C22C 33/08

[52] U.S. Cl. ..... 75/130 R; 75/53; 75/129; 75/130 A; 266/216

[58] Field of Search ..... 266/216; 75/130 R, 130 A, 75/130 AB, 129, 53

[56] References Cited

U.S. PATENT DOCUMENTS 3,870,512 3/1975 Lee ..... 75/130 R
3,881,937 5/1975 Teufel ..... 75/130 R
4,134,757 1/1979 Roberts ..... 75/130 R
4,312,668 1/1982 Mannion ..... 75/129

*Primary Examiner*—Peter D. Rosenberg
*Attorney, Agent, or Firm*—Armstrong, Nikaido, Marmelstein & Kubovcik

[57] ABSTRACT

A treatment unit is disclosed which comprises a pouring bush (1) opening directly or indirectly into an additive container (3) holding a reactive additive such as a nodularizing agent and which has an aperture at the top of its peripheral walls (*7c*) and optionally one or more other apertures (7) in its peripheral walls to allow the passage therethrough of molten metal. The additive container is housed within a covered jacket or funnel (4) for restricting contact of molten metal being treated with the atmosphere. The aperture at the top of the peripheral walls of the additive container may be in the form of an annular gap (*7b*) between the top of the additive container and either the bottom of the pouring bush or a cover provided for the funnel or jacket.

12 Claims, 4 Drawing Figures

APPARATUS AND PROCESS FOR THE TREATMENT OF MOLTEN METAL

This invention relates to an apparatus and to a process for the treatment of molten metal and, in particular, for the production of cast iron.

BACKGROUND OF THE INVENTION

Methods for the production of cast iron with spheroidal or nodular graphite or graphite forms other than flake normally involve the treatment of cast iron in the liquid state with suitable nodularisers such as Mg, Ca, Na, Li, Sr, Ba, Ce, Di, La, Yt and compounds and alloys thereof.

Many processes have been devised to introduce these nodularisers to cast iron either by direct introduction into a pouring ladle or by use of separate more complicated equipment.

A widely employed method is to place the nodulariser on the bottom of the pouring ladle and then tap molten metal onto it.

In this method the nodulariser may also be covered with steel punchings or inert material.

Other known methods make use of gas agitation and some rely on plunging the nodulariser below the metal surface.

All of these processes suffer certain limitations in that in some instances reliability of treatment is poor and excessive fume, flare, pyrotechnics and metal splashing are experienced due to the violence of reaction between metal and nodulariser.

Another known method involves introducing the reactive additive into a stream of the metal to be treated. One such method is described in U.K. Patent Specification No. 1,076,456 as being particularly suitable for introducing an alloying material into a steel melt. The apparatus described in U.K. Specification No. 1,076,456 includes a treatment chamber into which an alloying material is introduced through one opening simultaneously with a stream of molten metal through another opening. A closure body provided with passages is provided at the base of the treatment chamber in order to provide for accumulation of the melt with the alloying material. The treated melt is then conveyed through the passages in the closure body into a collecting ladle. The function of the treatment chamber described in Specification No. 1,076,456 is not to hold additives but to control the metal stream so as to permit introduction of additives into the stream. The apparatus includes elaborate provisions for the separate introduction of the alloying material and for scavenging the apparatus prior to use. Moreover, fume and pyrotechnics associated with introduction of the alloying material into the metal stream are not avoided as indicated by the provision of fume extraction equipment.

Our prior European patent application No. 79302553.7 (Published No. 0011478) described and claimed a treatment unit which is adapted to be located in, or above a pouring ladle, the treatment unit comprising a pouring bush opening directly or indirectly into a container holding solid additive and which is provided with a cover and, in its base and/or peripheral walls, with a plurality of holes to allow the passage therethrough of molten metal; and treatment unit also comprising means for restricting contact of molten metal being treated with the atmosphere selected from a cover for the pouring ladle and a funnel adapted to accommodate the container. This apparatus solved some of the problems associated with previous proposals but we found that the number of treatments that was possible with one container was limited and the container life was relatively short due to failure of the refractory material.

We have, therefore, sought to minimise the problems of these various prior proposals.

SUMMARY OF THE INVENTION

This has been achieved by virtue of the present invention which provides a treatment unit which is suitable for holding a reactive additive prior to and during a metal treatment process and which can conveniently be located so as to enable the treated metal to be transported into a pouring ladle.

Thus, the present invenion provides a treatemnt unit which comprises a pouring bush opening directly or indirectly into an additive container which is adapted to hold an additive and which has an aperture at the top of its peripheral walls and optionally one or more other apertures in its peripheral walls to allow the passage therethrough of molten metal and which is housed within a covered jacket or funnel for restricting contact of molten metal being treated with the atmosphere.

The treatment unit according to the invention is adapted to be located in, on or above a pouring ladle.

Preferably, the pouring bush opens directly into the additive container and is clamped or otherwise fastened to the jacket or funnel by means of an airtight seal. An asbestos seal may be conveniently employed for this purpose. The pouring bush may be centrally disposed above the additive container or, for operating convenience, it may be offset.

The additive container may be any convenient shape such as circular or rectangular and is provided with a single aperture or a plurality of apertures in its peripheral walls. At least one of the apertures must be provided at the top of the peripheral walls and this aperture may be provided by a gap between the top of the additive container and the bottom of the pouring bush or by a gap between the top of the additive container and a cover provided for the funnel or jacket. The additive container and the jacket or funnel may be made entirely from a refractory material or the jacket funnel may be made, for example, of steel with a refractory lining, having an aperture to permit entry of molten metal from the pouring bush.

The additive container may be constructed for example, using a wire cage covered with a refractory material.

According to another possibility, the additive container may be supported by the funnel or jacket. A funnel may be arranged so that the flow of metal changes direction on leaving the additive container and the additive container may be conveniently supported by a wall or base of the funnel.

According to another embodiment the additive container is surrounded, within the jacket or funnel, by a further refractory body. This refractory body contains one or more apertures which permit the flow of molten metal from the additive container into the jacket or funnel. The purpose of this further refractory body is to control the flow of metal and assist the reaction between metal and reactive alloy which may take place in the jacket or funnel.

Another method of controlling the flow of molten metal from the additive container into the pouring ladle and assisting any reaction between metal and reactive alloy which may take place within the jacket or funnel may be provided by one or more refractory shapes disposed within the jacket or funnel. This arrangement is such that the shape provides a means of controlling the metal flow pattern and aids in minimising the possibility of oxidation of reactive additive within the jacket or funnel.

We have found that reaction of the molten metal with the reactive additive takes place initially in the additive container and is continued in the jacket or funnel which leads into the pouring ladle. Although some reaction still continues in the pouring ladle the force of the reaction has diminished and generally there is not excessive fume and flare as compared for example with a conventional process wherein the molten metal is tapped directly on to the reactive additive contained at the bottom of a pouring ladle. Thus, the provision of the jacket or funnel may be sufficient to restrict contact of the molten metal being treated with the atmosphere.

The treatment unit according to the invention is suitable for use in metallurgical processes involving the addition of a reactive additive to molten metal, for example desulphurisation and inoculation processes. However, the treatment unit is particularly suitable for use in the production of cast iron wherein a nodularising agent is introduced into molten cast iron.

In the nodularisation process according to the invention, any of the well known nodularising metals, alloys, compounds or mixtures thereof may be used, preferably in lump or compacted/bonded shapes although powder forms may also be used. In the case where a powder is used it may be necessary to employ means such as guaze or wire either to hold the powder or to line the additive chamber in order to prevent the power running through the holes prior to a treatment run.

We have found that use of the apparatus according to the present invention affords several advantages over apparatus conventionally employed in foundries and over apparatus previously described in the literature.

In particular, we have found that compared with conventional foundry techniques, the apparatus according to the present invention permits a cleaner and safer process with much reduced fume and flare and no splashing when the reaction takes place. The unit is relatively cheap and adaptable and permits treatment temperatures to be easily varied, thus giving greater control over pouring temperature. We have demonstrated that a single unit can treat weights of metal in the range 200 to 600 kgs and 750–2000 kgs.

Other advantages of the apparatus according to the present invention are reduction in labour requirements (no need to prepare special cover plates or to use two ladles as in some conventional foundry processes) and improvement in overall treatment time. Heat energy is conserved by use of the apparatus according to this invention and the efficiency of the apparatus is such that the amount of inoculant or nodularizer for example, required can be reduced.

The apparatus according to the present invention has advantages over the apparatus described in our European patent application No. 79302553.7 (Published No. 0011478). In particular, the present apparatus has an extended working life. The location of one aperture, optionally in the form of a complete annular gap, at the top of the additive container results in a reduced tendency for the unit to become blocked. There is, moreover, a lessened danger of build up of back pressure from magnesium vapour (in the case of a magnesium-containing additive). The arrangement of apertures and the location of the additive container within the funnel or jacket also permits improved control over the alloy (additive) solution.

We have demonstrated that the apparatus according to the invention can be used in conjunction with both cupola and electric melting furnaces over a wide range of treatment weights.

The design of the unit and the method of operation of the treatment unit can be conveniently described by reference to the sketches in accompanying FIGS. 1 to 4 wherein

DETAILED DESCRIPTION OF THE INVENTION

Figure 1:
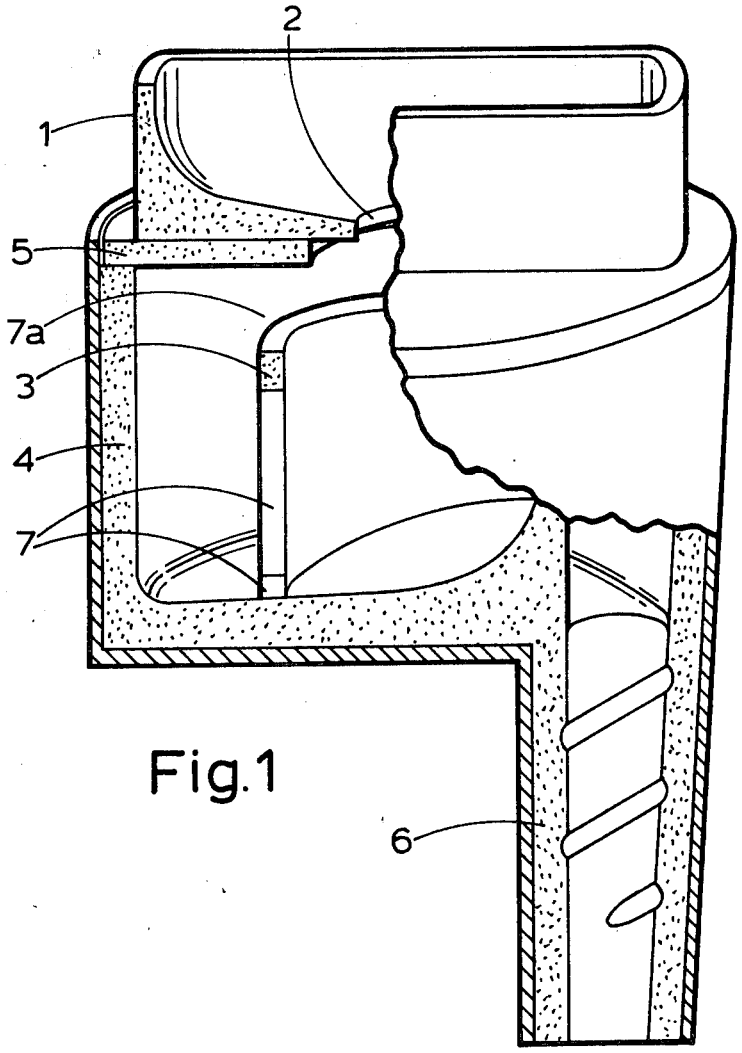
FIG. 1 is a view partly in section of an embodiment of a treatment unit according to the invention.

With reference to FIG. 1, the treatment unit comprises a pouring bush 1 which opens via an aperture 2 into an additive container 3. The additive container 3 is housed within a jacket or funnel 4 which is covered, for example, by a refractory lined plate 5.

The jacket has a tapered end 6 which ensures exit of the metal in a convenient manner. The essential purpose of this jacket is to prevent contact of the metal being treated with the atmosphere.

The additive container 3 can be made from steel with a refractory cover or it can be made solely from a refractory material.

The additive container 3 is provided with apertures 7 in its periphery walls. One of the apertures 7*a* is formed by provision of an annular gap between the top of the additive container 3 and the refractory plate cover 5.

The pouring bush, jacket or funnel container cover may be clamped together by means of clamps, and seals may optionally be used to ensure air-tight fits.

Figure 2:
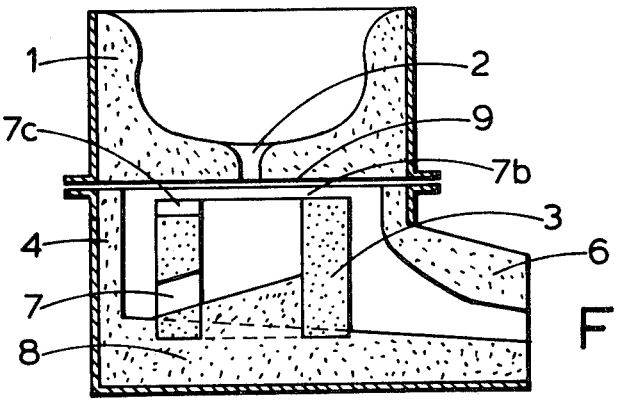
FIG. 2 is a section through another embodiment of a treatment unit according to the invention.

With reference to FIG. 2, the treatment unit comprises an additive container 3 having apertures 7 in its periphery walls. The additive container is supported by the base 8 of the funnel 4. One of the apertures 7*b* is an annular gap between the top of the walls of the unit and the base 9 of the pouring bush. The aperture 7*b* is widened at one part 7*c*. The treated metal exits from its unit via the funnel 4 which changes direction at its tapered end 6.

Figure 3:
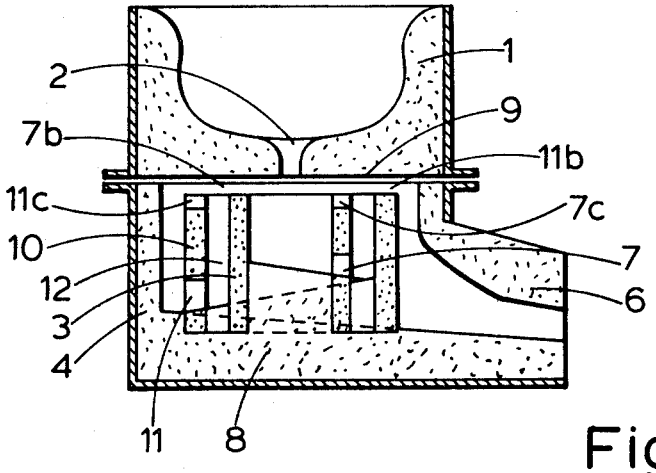
FIG. 3 is a section through an embodiment of a treatment unit according to the invention including an additional refractory body surrounding the container.

With reference to FIG. 3, the treatment unit comprises an additives container 3 having apertures 7 in its periphery walls. One of the apertures 7*b* is provided by an annular gap between the top of the walls of the unit and base 9 of the pouring bush. The aperture 7*b* is widened at one part 7*c*. The container 3 is surrounded by a refractory body 10 which contains apertures 11. One of these apertures 11*b* is provided by an annular gap between the top of the unit and base 9 of the pouring bush. The aperture 11*b* is widened at one part 11*c*. The treated metal passes from container 3 through apertures 7, 7*b* and 7*c* into an intermediate zone 12 between the container and the refractory body 10, through apertures 11 and into the funnel 4 which changes direction at its tapered end 6.

Figure 4:
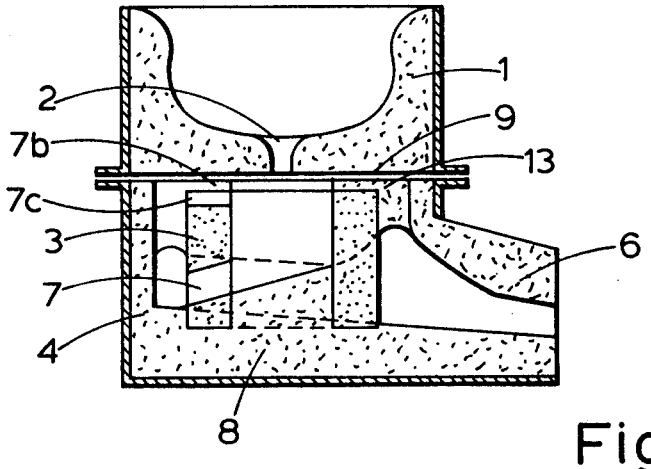
FIG. 4 is a section through another embodiment of a treatment unit according to the invention which includes a refractory shape to control metal flow.

FIG. 4 illustrates a treatment unit similar to that of FIG. 2 but also incorporating a refractory shape 13 located in the funnel 4. This shape provides an additional means of controlling the rate and direction of flow of treated metal together with minimizing the possibility of the reactive additive oxidising within the funnel or jacket.

For convenience of operation the entire treatment unit can be used in conjunction with a melting furnace.

The treatment unit according to the invention may be incorporated within a launder or it may be arranged between a furnace and pouring ladle. According to another possibility, the treatment unit according to the invention may be used to process metal during transfer from one pouring ladle to another.

In operation a reactive additive such as a nodularising agent in lump, compacted or granulated form is placed in the additive container, either by removing the cover and pouring bush to facilitate entry to the container or by introducing it through the aperture in the pouring bush.

A pouring ladle or furnace launder is positioned with its exit orifice immediately above the pouring bush. Molten metal is allowed to flow directly from the furnace via the launder into the pouring bush and subsequently into the additive container.

The molten metal passes over/through the additive and then exits through the aperture or apertures in the additive container.

The metal can then either exit from the chamber proportionally via the aperture(s) in the side walls of the container and via the aperture(s) or gap between the top of the additive container and the jacket or funnel cover or entirely via the aperture(s) in the side walls.

The reaction of the molten metal with the reactive additive takes place initially in the additive container and is continued in the jacket or funnel which leads into the pouring ladle.

Although some reaction still continues in the pouring ladle the force of the reaction has diminished and generally there is no excessive fume and flare as compared for example with a conventional process wherein the molten metal is tapped directly on to the reactive additive contained at the bottom of a pouring ladle.

The invention is further illustrated by the following Examples which describe a nodularisation process.

EXAMPLE 1

A treatment unit according to the invention as illustrated in FIG. 2 was positioned so as to be able to process metal by transferring it from one pouring ladle to another.

A predetermined quantity of nodularising agent based on a 2.0% addition relative to the amount of molten metal to be treated was placed in the nodulariser container.

In this example the nodulariser used contained a nominal 5–6% magnesium and was in the form of 1–4 mm granules.

300 kg of molten flake cast iron of suitable composition was then poured through the treatment unit for a period of some twenty-thirty seconds during which time the nodulariser was dissolved, the treated metal being collected into the pouring ladle.

This treatment was accomplished with virtually complete absence of fume or pyrotechnics.

Subsequent examination of treated metal gave the following results.

| Metal Composition | | | | | | |
|---|---|---|---|---|---|---|
| % T.C. | % Si | % S | % P | % Mn | % Cu | % Mg |
| 3.38 | 2.44 | 0.008 | 0.038 | 0.20 | 0.14 | 0.038 |

| Structure | |
|---|---|
| Nodular form graphite | Pearlitic/Ferritic matrix |

| Mechanical Properties | |
|---|---|
| Tensile N/mm$^2$ | Elongation % |
| 673 | 13 |

The procedure as described in Example 1 was repeated including use of the process in treating metal direct from a furnace using both granular and lump nodulariser.

The following further Examples are typical.

EXAMPLE 2

The procedure was as described in Example 1

| Metal Composition | | | | | | |
|---|---|---|---|---|---|---|
| % T.C. | % Si | % S | % P | % Mn | % Cu | % Mg |
| 3.60 | 2.40 | 0.011 | 0.03 | 0.22 | 0.45 | 0.042 |

| Structure | |
|---|---|
| Nodular Form Graphite | Pearlitic/Ferritic matrix |

| Mechanical Properties | |
|---|---|
| Tensile N/mm$^2$ | Elongation % |
| 785 | 6 |

EXAMPLE 3

The procedure was described in Example 1.

| Metal Composition | | | | | | |
|---|---|---|---|---|---|---|
| % T.C. | % Si | % S | % P | % Mn | % Cu | % Mg |
| 3.67 | 2.43 | 0.006 | — | 0.22 | 0.28 | 0.041 |

| Structure | |
|---|---|
| Nodular Form Graphite | Pearlitic/Ferritic matrix |

| Mechanical Properties | |
|---|---|
| Tensile N/mm$^2$ | Elongation % |
| 664 | 9 |

EXAMPLE 4

Use of Unit in Conjunction with a Cupola Furnace and Metal Receiver

The treatment unit as shown by the accompanying FIG. 2 was positioned in front of a metal receiver which contained a quantity of desulphurised metal of suitable composition.

A pre-determined quantity of nodularising agent based on 2% relative to the amount of molten metal to be treated was placed in the nodulariser container.

In this example the nodulariser used contained a nominal 5% magnesium and was in the form of 1–4 mm granules.

90 kg of the molten cast iron from the receiver was poured through the treatment unit for a period of some 15 seconds during which time the nodulariser was dissolved, the treated metal being collected in the pouring ladle.

This treatment was accomplished with virtually complete absence of fume or pyrotechnics.

Subsequent examination of the treated metal gave the following typical results.

| Metal Composition | | | | |
|---|---|---|---|---|
| % T.C. | % Si | % S | % Mn | % Mg |
| 3.68 | 2.84 | <0.01 | 0.54 | 0.047 |
| Structure | | | | |
| Nodular form graphite | | | Ferritic matrix | |
| Mechanical Properties | | | | |
| Treated Metal Annealed Condition | | | | |
| Tensile N/mm$^2$ | | | Elongation % | |
| 432 | | | 20 | |

EXAMPLE 5

In this case a treatment unit as in accompanying FIG. 2 capable of treating up to 2 ton of metal was positioned in front of an electric furnace which contained a bath of metal of suitable composition.

A predetermined quantity of nodularising agent based on a 2.0% addition relative to the amount of molten metal to be treated was placed in the nodulariser container.

In this example the nodulariser used contained a nominal 5% magnesium and was in the form of 1-4 mm granules.

700 kg of the metal was then poured through the treatment unit for a period of some 60 seconds during which time the nodulariser was dissolved, the treated metal being collected in the pouring ladle.

Subsequent examination of the treated metal gave the following results.

| Metal Composition | | | | | |
|---|---|---|---|---|---|
| % T.C. | % Si | % S | % Mn | % Cu | % Mg |
| 3.53 | 2.19 | 0.006 | 0.20 | 0.63 | 0.046 |
| Structure | | | | | |
| Nodular form graphite | | | | Pearlitic matrix | |
| Mechanical Properties | | | | | |
| Treated Metal As cast condition | | | | | |
| Tensile N/mm$^2$ | | | | % Elongation | |
| 784 | | | | 5 | |

We claim:

1. An apparatus for the treatment of molten metal, said apparatus comprising:

(a) an additive container means for receiving molten metal and holding an additive to be added to the molten metal upon contact between the molten metal and the additive, said additive container means including at least one aperture in the top thereof;

(b) a pouring bush for receiving molten metal, said pouring bush being positioned such that it opens into said additive container means; and (c) housing means for housing said additive container means and for containing the molten metal after it exits from said additive container means through said at least one aperture, said housing means preventing contact between the molten metal and the atmosphere.

2. An apparatus as set forth in claim 1, wherein said additive container means includes at least one aperture in the peripheral walls thereof.

3. A treatment unit according to claim 1, wherein the additive container means is supported by said housing means.

4. A treatment unit according to claim 1 or 2, wherein the additive container means is surrounded by a refractory body containing at least one aperture.

5. A treatment unit according to claim 1, wherein the pouring bush is attached to or integral with a furnace launder.

6. A treatment unit according to claim 1, which further comprises a pouring ladle.

7. A process for the treatment of molten metal by the introduction of a solid reactive additive said process comprising the steps of placing the solid reactive additive in a container which has an aperture at the top of its peripheral walls and at least one other aperture in its peripheral walls, passing molten metal to be treated via a pouring bush into contact with the reactive additive in the container wherein the metal reacts with the additive, allowing the metal containing the additive to flow through the apertures in the container into a pouring ladle positioned beneath the additive container, wherein contact of the molten metal being treated with the atmosphere is restricted by means of a covered housing means housing the container.

8. A process according to claim 7, wherein the molten metal is cast iron and the reactive additive is a nodularizing agent.

9. An apparatus as set forth in claims 1 or 2, wherein said aperture in the top of said additive container means includes a gap between the top of said additive container means and the bottom of said pouring bush.

10. An apparatus as set forth in claim 1, wherein said housing means includes a funnel.

11. An apparatus as set forth in claim 1, wherein said housing means includes a covered jacket.

12. An apparatus as set forth in claim 3, wherein said housing means includes a refractory material having a predetermined shape.

* * * * *